US009988762B2

(12) United States Patent
Bilodeau et al.

(10) Patent No.: US 9,988,762 B2
(45) Date of Patent: Jun. 5, 2018

(54) HIGH EFFICIENCY PRODUCTION OF NANOFIBRILLATED CELLULOSE

(71) Applicant: University of Maine System Board of Trustees, Bangor, ME (US)

(72) Inventors: Michael A. Bilodeau, Brewer, ME (US); Mark A. Paradis, Old Town, ME (US)

(73) Assignee: University of Maine System Board of Trustees, Bangor, ME (US)

( * ) Notice: Subject to any disclaimer, the term of this patent is extended or adjusted under 35 U.S.C. 154(b) by 0 days. days.

(21) Appl. No.: 15/309,117

(22) PCT Filed: May 6, 2015

(86) PCT No.: PCT/US2015/029396
§ 371 (c)(1),
(2) Date: Nov. 4, 2016

(87) PCT Pub. No.: WO2015/171714
PCT Pub. Date: Nov. 12, 2015

(65) Prior Publication Data

US 2017/0073893 A1 Mar. 16, 2017

Related U.S. Application Data

(60) Provisional application No. 61/989,893, filed on May 7, 2014, provisional application No. 62/067,053, filed on Oct. 22, 2014.

(51) Int. Cl.
*D21H 11/18* (2006.01)
*D21C 9/00* (2006.01)
*D21D 1/30* (2006.01)

(52) U.S. Cl.
CPC ..... *D21D 1/30* (2013.01); *D21C 9/007* (2013.01); *D21D 1/303* (2013.01); *D21D 1/306* (2013.01); *D21H 11/18* (2013.01)

(58) Field of Classification Search
CPC ..... D21H 11/18; D21D 1/30; D21D 1/303; D21D 1/306; D21C 9/007; B82Y 30/00; B82Y 40/00; D21B 1/14
See application file for complete search history.

(56) References Cited

U.S. PATENT DOCUMENTS

| | | | | |
|---|---|---|---|---|
| 4,529,137 | A | 7/1985 | Matthew et al. | |
| 5,425,508 | A | 6/1995 | Chaney | |
| 5,740,972 | A * | 4/1998 | Matthew | B02C 7/12 241/261.3 |
| 5,893,525 | A | 4/1999 | Gingras | |
| 5,921,486 | A * | 7/1999 | Matthew | D21D 1/306 241/298 |
| 5,954,283 | A * | 9/1999 | Matthew | D21D 1/306 241/298 |
| 7,300,550 | B2 * | 11/2007 | Sabourin | B02C 7/12 162/23 |
| 7,381,294 | B2 | 6/2008 | Suzuki et al. | |
| 7,779,525 | B2 | 8/2010 | Matthew | |
| 8,546,558 | B2 * | 10/2013 | Ankerfors | D21H 11/18 162/24 |
| 8,663,425 | B2 * | 3/2014 | Noishiki | D21H 11/18 156/307.1 |
| 8,734,611 | B2 * | 5/2014 | Sabourin | D21B 1/021 162/28 |
| 8,789,775 | B2 * | 7/2014 | Fursattel | D21D 1/24 241/21 |
| 9,051,684 | B2 * | 6/2015 | Hua | D21D 1/20 |
| 9,074,077 | B2 * | 7/2015 | Harada | B82Y 30/00 |
| 9,267,234 | B2 * | 2/2016 | Huhtanen | D21D 1/22 |
| 9,297,112 | B2 * | 3/2016 | Mesic | D21H 23/04 |
| 9,739,011 | B2 * | 8/2017 | Tamper | D21D 1/20 |
| 2005/0194477 | A1 | 9/2005 | Suzuki | |
| 2006/0006265 | A1 * | 1/2006 | Sabourin | B02C 7/12 241/261.2 |

(Continued)

FOREIGN PATENT DOCUMENTS

| | | | |
|---|---|---|---|
| CA | 2856151 A1 * | 5/2013 | D21D 1/36 |
| CA | 2948329 A1 * | 11/2015 | D21D 1/30 |

(Continued)

OTHER PUBLICATIONS

PCT International Search Report and Written Opinion, Application No. PCT/US2015/029396, dated Oct. 13, 2015.
Bilodeau et al., "Potential applications of nanofibrillated cellulose in printing and writing papers", 2012 Tappi International Conference on Nanotechnology for Renewable Material, 2012.
Eriksen et al., "The use of microfibrillated cellulose produced from kraft pulp as strength enhancer in TMP paper", Nordic Pulp & Paper Research Journal, 2008, vol. 23, Issue 3, pp. 299-304, Abstract only.
Gonzalez et al., "Nanofibrillated cellulose as paper additive in eucalyptus pulps", BioResources, 2012, vol. 7, No. 4, pp. 5167-5180, Abstract only.
Hamilton, "Using Renewable Nanotechnology (and Other Novel Approaches) to Improve Base Paper Performance", AWA Silicone Technology Seminar, 2014.
Lumiainen, Chapter 4, "Refining of chemical pulp", Papermaking Part 1, Stock Preparation and Wet End, pp. 1-59.

(Continued)

*Primary Examiner* — Jose A Fortuna
(74) *Attorney, Agent, or Firm* — MacMillan, Sobanski & Todd, LLC

(57) ABSTRACT

A scalable, energy efficient process for preparing cellulose nanofibers employs treating the cellulosic material with a first mechanical refiner with plates having a configuration of blades separated by grooves, and subsequently treating the material with a second mechanical refiner with plates having a configuration of blades separated by grooves different than the first refiner. The plate configurations and treatment operations are selected such that the first refiner produces a first specific edge loading (SEL) that is greater than the SEL of the second refiner, by as much as 2-50 fold. An exemplary high first SEL may be in the range of 1.5 to 8 J/m. Paper products made with about 2% to about 30% cellulose nanofibers having a length from about 0.2 mm to about 0.5 mm, preferably from 0.2 mm to about 0.4 mm have improved properties.

12 Claims, 13 Drawing Sheets

(56) References Cited

U.S. PATENT DOCUMENTS

2007/0164143 A1* 7/2007 Sabourin ..... B02C 7/12 241/261.2
2008/0078854 A1* 4/2008 Sabourin ..... B02C 7/12 241/261.2
2009/0221812 A1* 9/2009 Ankerfors ..... D21C 5/005 536/56
2009/0288789 A1* 11/2009 Sabourin ..... D21B 1/021 162/24
2010/0178523 A1 7/2010 Iyengar et al.
2013/0017394 A1* 1/2013 Hua ..... D21D 1/20 428/401
2013/0270377 A1* 10/2013 Gingras ..... D21B 1/26 241/220
2014/0057105 A1* 2/2014 Pande ..... D21B 1/04 428/401
2014/0217218 A1* 8/2014 Huhtanen ..... D21D 1/22 241/261.3
2014/0284407 A1* 9/2014 Tamper ..... D21D 1/36 241/21
2015/0167243 A1* 6/2015 Bilodeau ..... D21C 5/005 162/65
2016/0102433 A1* 4/2016 Nuopponen ..... D21D 1/004 162/28
2016/0289893 A1* 10/2016 Martin ..... B82Y 40/00
2016/0333524 A1* 11/2016 Pande ..... D21B 1/04
2016/0340802 A1* 11/2016 Pande ..... D21B 1/04
2017/0073893 A1* 3/2017 Bilodeau ..... D21D 1/30
2017/0107666 A1* 4/2017 Kajanto ..... D21C 5/005
2017/0211230 A1* 7/2017 Nuopponen ..... D21B 1/14

FOREIGN PATENT DOCUMENTS

EP 2794986 B1 * 7/2017 ..... D21D 1/36
WO WO-2011098147 A1 * 8/2011 ..... D21D 1/306
WO 2012101330 A1 8/2012
WO WO-2013072559 A1 * 5/2013 ..... D21D 1/36
WO WO-2015171714 A1 * 11/2015 ..... D21D 1/30
WO WO-2017033125 A1 * 3/2017 ..... D21D 1/20

OTHER PUBLICATIONS

Taipale, et al., "Effect of microfibrillated cellulose and fines on the drainage of kraft pulp suspension and paper strength", Cellulose, 2010, vol. 17, pp. 1005-1020, Abstract only.
PCT International Preliminary Report on Patentability, Application No. PCT/US2015/029396, dated Nov. 8, 2016.

* cited by examiner

HIGH EFFICIENCY PRODUCTION OF NANOFIBRILLATED CELLULOSE

RELATED APPLICATIONS

This application claims priority to provisional application 61/989,893 filed May 7, 2014, and to provisional application 62/067,053 filed Oct. 22, 2014, both of which are incorporated herein by reference.

BACKGROUND OF THE INVENTION

The present invention relates generally to the field of cellulosic pulp processing, and more specifically to the processing of cellulosic pulp to prepare nanocellulose fibers, also known in the literature as microfibrillated fibers, microfibrils and nanofibrils. Despite this variability in the literature, the present invention is applicable to microfibrillated fibers, microfibrils and nanofibrils, independent of the actual physical dimensions.

Nanofibrillated celluloses have been shown to be useful as reinforcing materials in wood and polymeric composites, as barrier coatings for paper, paperboard and other substrates, and as a paper making additive to control porosity and bond dependent properties.

Conventionally, chemical pulps produced using Kraft, soda or sulfite cooking processes have been bleached with chlorine-containing bleaching agents. Although chlorine is a very effective bleaching agent, the effluents from chlorine bleaching processes contain large amounts of chlorides produced as the by-product of these processes. These chlorides readily corrode processing equipment, thus requiring the use of costly materials in the construction of bleach plants. In addition, there are concerns about the potential environmental effects of chlorinated organics in bleach plant effluents. Other known pretreatment processes include oxygen-based compounds, such as ozone, peroxide and oxygen, for the purpose of delignifying, i.e. bleaching pulp.

The bleaching and other pretreatment of pulps however is distinct from and, by itself, does not result in release of nanocellulose fibers. A further mechanical refining or homogenization is typically required, and refining processes are generally divided into high and low consistency, which refers to the solids content of the pulp slurry being considered. Low consistency refining generally consists of 2-6% by weight solids. Mechanical refining requires a great deal of energy to mechanically and physically break the cellulose fibers into smaller fragments. Required energy is a complex mix of many variables related to the refiner itself, the pulp mixture to be refined, and the configuration of the refiner blades, or plates. According to one popular theory, specific edge loading, (SEL) is a useful measure of the "intensity" of refining. It contemplates both the number of impacts and the intensity of the impacts that a fiber "sees" during one revolution of the refiner plates. The number of impacts (as a rate) is related to the blade configuration and is given by the total cutting edge length per rotation (CEL) and rotational speed. The intensity of such impacts is related to the energy transferred to the fiber, or "net" power consumption, and is given by the total power applied minus the no-load power, or ($p-p^0$). Thus, the SEL may be defined as the effective energy expended per bar crossing per unit bar length. The mathematical definition is shown in the equation below, where Ω is the rotational speed of the refiner and other terms are as defined above.

$$SEL=(p-p^0)/\Omega*CEL.$$

SEL units are given in Watt-seconds/meter (Ws/m) or the equivalent Joules/meter (J/m).

Frequently multiple stages of homogenization or refining, or both, are required to achieve a nano-sized cellulose fibril. For example, U.S. Pat. No. 7,381,294 to Suzuki et al. describes multiple-step refining processes requiring 10 or more, and as many as 30-90 refining passes. The refining passes or stages may use the same or different conditions. The process described by Suzuki et al generally produces fibers having a length of 0.2 mm or less, by many refiner passes, resulting in very high specific energy consumption, for both pumping and refining operations. Suzuki's teaching does not take into account the intensity of the impacts and does not calculate the SEL.

A second example is provided by US 2014/0057105 to Pande et al. in which fibers are refined in one or more stages to increase hydrodynamic surface area without a substantial reduction in fiber length.

It would be advantageous if there could be developed improved processes for cellulosic pulp processing, particularly a process that reduced the energy required to produce nanofibrils. Longer fibers are also preferred for some applications.

SUMMARY OF THE INVENTION

A novel method to isolate nanofibrillated cellulose from lignocellulosic materials at commercially significant volumes has been developed. The method employs a series of specific mechanical treatments that significantly lowers the energy required to produce the nanofibrillated cellulose when compared to prior art.

In one aspect, the invention comprises an improved process for preparing cellulose nanofibers (also known as cellulose nanofibrils, or CNF, and as nanofibrillated cellulose (NFC) and as microfibrillated cellulose (MFC)) from a cellulosic material, comprising:

treating the cellulosic material with a first mechanical refiner having stator and rotor plates having a configuration of blades separated by grooves, the first refiner producing a first beginning SEL; and subsequently treating the cellulosic material with a second mechanical refiner having stator and rotor plates having a configuration of blades separated by grooves that is different than the configuration of the first refiner, the second refiner producing a second beginning SEL;

wherein first beginning SEL is greater than the second beginning SEL.

In some embodiments, the SEL produced by operating the first refiner is about 2 to 40 times higher than the SEL produced by operating the second refiner, for example about 5 to 30 times higher, or about 6 to 20 times higher. In some embodiments, the first beginning SEL is in the range from about 1.5 to about 8.0 J/m, for example from about 2.0 to about 5.0 J/m; while the beginning SEL of the second refiner is generally less than 1.5 J/m, for example less than 1.0 J/m or from about 0.05 to about 0.95 J/m.

In some embodiments, the configuration of blades separated by grooves on the plates of the first refiner has a lower CEL than the CEL of the configuration of blades separated by grooves on the plates of the second refiner. The blades and grooves inherently have widths. In some embodiments, the ratio of blade:groove widths of the plates of the first refiner is greater than the ratio of blade:groove widths of the plates of the second refiner. For example, the ratio of blade:groove widths of the first refiner plates may be greater than 1.0 and the ratio of blade:groove widths of the second refiner plates may be less than 1.0

According to this invention there is also provided a paper product incorporating cellulose nanofibers prepared by the process.

A further aspect of the present invention is paper products made using cellulose nanofibers made by any of the processes described above. Such paper products have improved properties, such as porosity, smoothness, and strength.

A further aspect of the present invention is the production of fibers of somewhat longer median length; for example longer than 0.2 mm and preferably in the range of about 0.2 mm to about 0.4 mm.

Other advantages and features are evident from the following detailed description.

BRIEF DESCRIPTION OF THE DRAWINGS

The accompanying drawings, incorporated herein and forming a part of the specification, illustrate the present invention in its several aspects and, together with the description, serve to explain the principles of the invention. In the drawings, the thickness of the lines, layers, and regions may be exaggerated for clarity.

Various aspects of this invention will become apparent to those skilled in the art from the following detailed description of the preferred embodiment, when read in light of the accompanying drawings.

DETAILED DESCRIPTION

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are described herein. All references cited herein, including books, journal articles, published U.S. or foreign patent applications, issued U.S. or foreign patents, and any other references, are each incorporated by reference in their entireties, including all data, tables, figures, and text presented in the cited references.

Numerical ranges, measurements and parameters used to characterize the invention—for example, angular degrees, quantities of ingredients, polymer molecular weights, reaction conditions (pH, temperatures, charge levels, etc.), physical dimensions and so forth—are necessarily approximations; and, while reported as precisely as possible, they inherently contain imprecision derived from their respective measurements. Consequently, all numbers expressing ranges of magnitudes as used in the specification and claims are to be understood as being modified in all instances by the term "about." All numerical ranges are understood to include all possible incremental sub-ranges within the outer boundaries of the range. Thus, a range of 30 to 90 units discloses, for example, 35 to 50 units, 45 to 85 units, and 40 to 80 units, etc. Unless otherwise defined, percentages are wt/wt %.

Cellulosic Materials

Cellulose, the principal constituent of "cellulosic materials," is the most common organic compound on the planet. The cellulose content of cotton is about 90%; the cellulose content of wood is about 40-50%, depending on the type of wood. "Cellulosic materials" includes native sources of cellulose, as well as partially or wholly delignified sources. Wood pulps are a common, but not exclusive, source of cellulosic materials.

Figure 1:
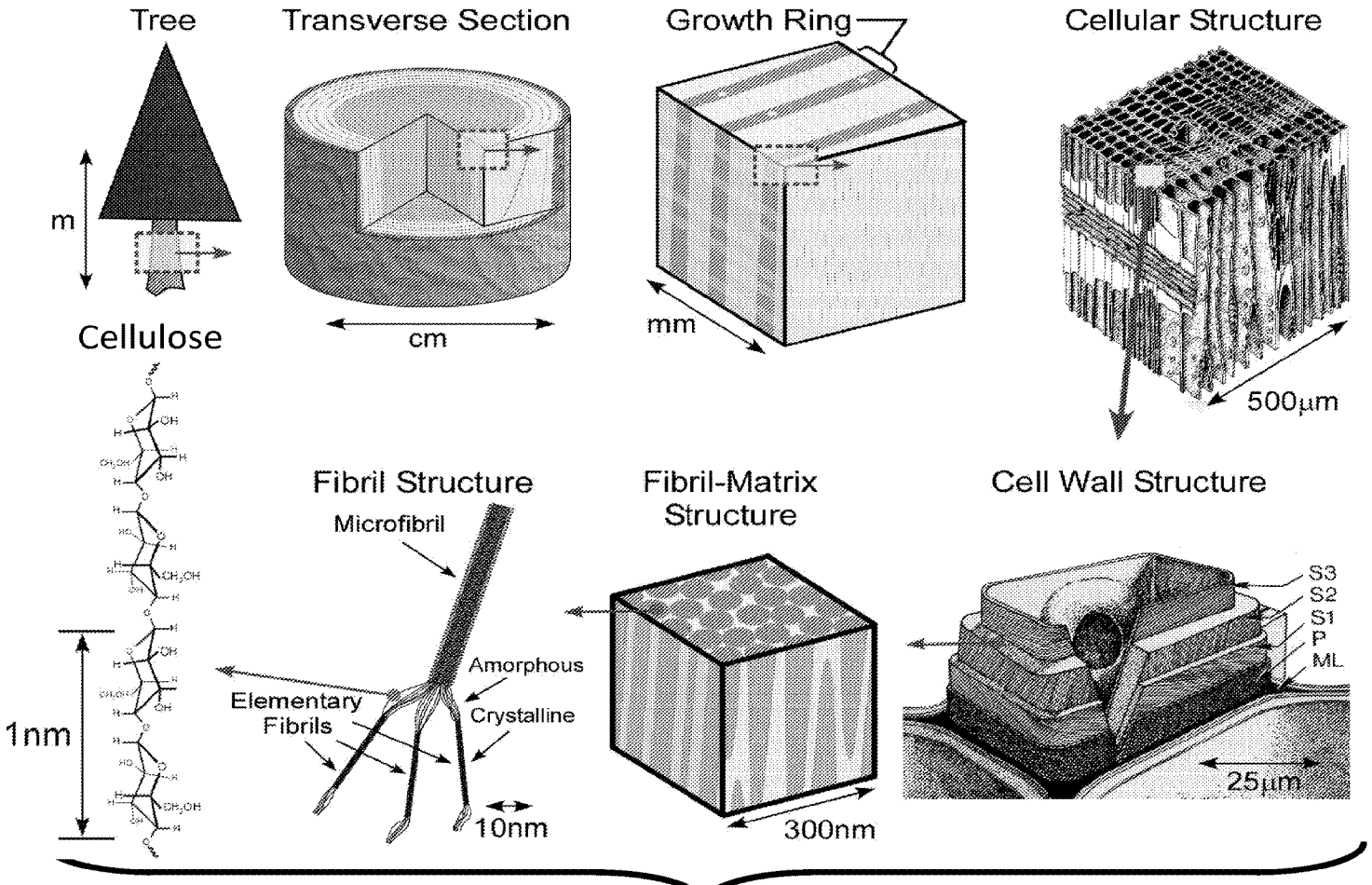
FIG. 1 is a schematic illustration showing some of the components of a cellulosic fiber such as wood.

FIG. 1 presents an illustration of some of the components of wood, starting with a complete tree in the upper left, and, moving to the right across the top row, increasingly magnifying sections as indicated to arrive at a cellular structure diagram at top right. The magnification process continues downward to the cell wall structure, in which S1, S2 and S3 represent various secondary layers, P is a primary layer, and ML represents a middle lamella. Moving left across the bottom row, magnification continues up to cellulose chains at bottom left. The illustration ranges in scale over 10 orders of magnitude from trees that may be 10 meters in height, through millimeter-sized (mm) growth rings and micron-sized (μm) cellular structures, to microfibrils and cellulose chains that are nanometer (nm) dimensions. In the fibril-matrix structure of the cell walls of some woods, the long fibrils of cellulose polymers combine with 5- and 6-member polysaccharides, hemicelluloses and lignin.

As depicted in FIG. 1, cellulose is a polymer derived from D-glucose units, which condense through beta (1-4)-glycosidic bonds. This linkage motif is different from the alpha (1-4)-glycosidic bonds present in starch, glycogen, and other carbohydrates. Cellulose therefore is a straight chain polymer: unlike starch, no coiling or branching occurs, and the molecule adopts an extended and rather stiff rod-like conformation, aided by the equatorial conformation of the glucose residues. The multiple hydroxyl groups on a glucose molecule from one chain form hydrogen bonds with oxygen atoms on the same or on a neighbor chain, holding the cellulose chains firmly together side-by-side and forming elementary nanofibrils. Cellulose nanofibrils (CNF) are similarly held together in larger fibrils known as microfibrils; and microfibrils are similarly held together in bundles or aggregates in the matrix as shown in FIG. 1. These fibrils and aggregates provide cellulosic materials with high tensile strength, which is important in cell walls conferring rigidity to plant cells.

As noted, many woods also contain lignin in their cell walls, which give the woods a darker color. Thus, many wood pulps are bleached to whiten the pulp for use in paper and many other products. The lignin is a three-dimensional polymeric material that bonds the cellulosic fibers and is also distributed within the fibers themselves. Lignin is largely responsible for the strength and rigidity of the plants.

For industrial use, cellulose is mainly obtained from wood pulp and cotton, and largely used in paperboard and paper. However, the finer cellulose nanofibrils (CNF) or microfibrillated cellulose (MFC), once liberated from the woody plants, are finding new uses in a wide variety of products. For example, nanocellulose fibers still find utility in the paper and paperboard industry, as was the case with traditional pulp. However, their rigidity and strength properties have found myriad uses beyond the traditional pulping uses.

Cellulose nanofibers have many advantages over other materials: they are natural and biodegradable, giving them lower toxicity and better "end-of-life" options than many current nanomaterials and systems; their surface chemistry is well understood and compatible with many existing systems, including ecosystems; and they are commercially scalable. For example, coatings, barriers and films can be strengthened by the inclusion of nanocellulose fibers. Composites and reinforcements that might traditionally employ glass, mineral, ceramic or carbon fibers, may suitably employ nanocellulose fibers instead.

The high surface area of these nanofibers makes them well suited for absorption and imbibing of liquids, which is a useful property in hygienic and medical products, food packaging, and in oil recovery operations. They also are capable of forming smooth and creamy gels that find application in cosmetics, medical and food products.

General Pulping and Bleaching Processes

Wood is converted to pulp primarily for use in paper manufacturing. Pulp comprises wood fibers capable of being slurried or suspended and then deposited on a screen to form a sheet of paper. There are two main types of pulping techniques: mechanical pulping and chemical pulping. In mechanical pulping, the wood is physically separated into individual fibers. In chemical pulping, the wood chips are digested with chemical solutions to solubilize a portion of the lignin and thus permit its removal. The commonly used chemical pulping processes include: (a) the sulfate (aka "kraft") process, (b) the sulfite process, and (c) the soda process. These processes need not be described here as they are well described in the literature, including Smook, Gary A., Handbook for Pulp & Paper Technologists, Tappi Press, 1992 (especially Chapter 4), and the article: "Overview of the Wood Pulp Industry," Market Pulp Association, 2007. The kraft process is the most commonly used and involves digesting the wood chips in an aqueous solution of sodium hydroxide and sodium sulfide. The wood pulp produced in the pulping process is usually separated into a fibrous mass and washed.

The wood pulp after the pulping process is dark colored because it contains residual lignin not removed during digestion. The pulp has been chemically modified in pulping to form chromophoric groups. In order to lighten the color of the pulp, so as to make it suitable for white paper manufacture and also for further processing to nanocellulose or MFC, the pulp is typically, although not necessarily, subjected to a bleaching operation which includes delignification and brightening of the pulp. The traditional objective of delignification steps is to remove the color of the lignin without destroying the cellulose fibers. The ability of a compound or process to selectively remove lignins without degrading the cellulose structure is referred to in the literature as "selectivity."

General MFC Processes

A generalized process for producing nanocellulose or fibrillated cellulose is disclosed in PCT Patent Application No. WO 2013/188,657, which is herein incorporated by reference in its entirety.

The process includes the steps in which the wood pulp is mechanically broken down in any type of mill or device that grinds the fibers apart. Such mills are well known in the industry and include, without limitation, Valley beaters, single disc refiners, double disc refiners, conical refiners, including both wide angle and narrow angle, cylindrical refiners, homogenizers, microfluidizers, and other similar milling or grinding apparatus. These mechanical refiner devices need not be described in detail herein, since they are well described in the literature, for example, Smook, Gary A., Handbook for Pulp & Paper Technologists, Tappi Press, 1992 (especially Chapter 13). Tappi standard T 200 (sp 2010) describes a procedure for mechanical processing of pulp using a beater. The process of mechanical breakdown, regardless of instrument type, is generally referred to in the literature as "refining" or sometimes generically as "comminution."

Disc refiners, including double disc refiners, and conical refiners are among the most common refiner devices. Disc refiners involve one or two plates (aka "rotors") that are rotatable against at least one other plate (aka "stator"). Some patents describing various refiner plates include U.S. Pat. No. 5,425,508 to Chaney, U.S. Pat. No. 5,893,525 to Gingras, and U.S. Pat. No. 7,779,525 to Matthew. Some examples of disc refiners include Beloit DD 3000, Beloit DD 4000 or Andritz refiners. Some examples of conical refiners include Sunds JC01, Sunds J C 02, and Sunds JC03 refiners. The plates have bars and grooves in many, varied configurations as shown in FIGS. 2A-2F and 3A to 3F. The bars and grooves extend in a generally radial direction, but typically at an angle (often designated a) of about 10 to 20 degrees relative to a true radial line. In some configurations the bars and grooves are continuous (e.g. FIGS. 2A, 2D, 3D, and 3E); while in other embodiments the bars are staggered to create "dead end" flow paths forcing the pulp up and over the bar grinding edge (e.g. FIGS. 2B, 2C, and 2E), sometimes having ramps or tapered edges (e.g. FIG. 2E) that force the pulp upward out of the "dead end". In some embodiments the bars and grooves may be curved (e.g. FIG. 3D) or zig-zag (e.g. FIGS. 3E and 3F). The grooves may be continuous or interrupted (e.g. FIG. 3F). In some embodiments the bars and grooves may change pitch (the number of bars/grooves per arc distance), typically progressing from fewer, wider grooves near the center to more plentiful, narrower grooves towards the periphery (e.g. FIGS. 3A to 3C).

Figure 2A:
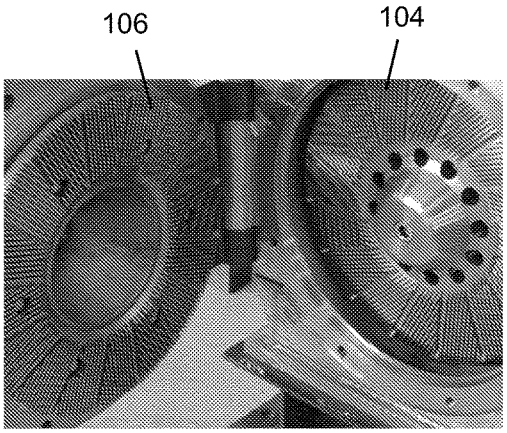
FIGS. 2A to 2F are views of various disc plate configurations useful in disc refining according to the invention.
Figure 2B:
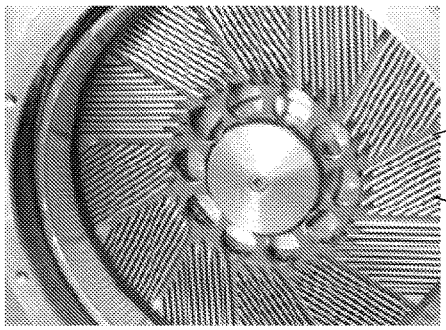
Figure 2C:
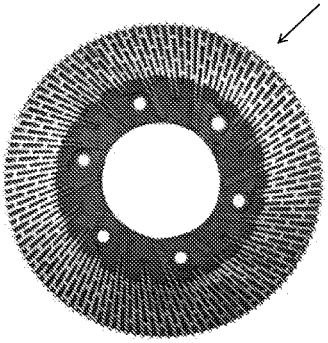
Figure 2D:
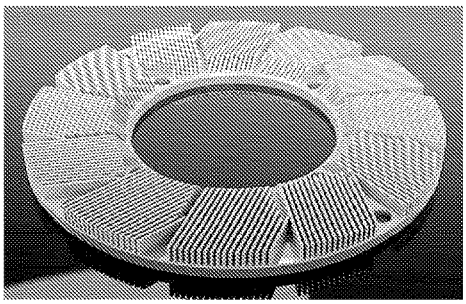
Figure 2E:
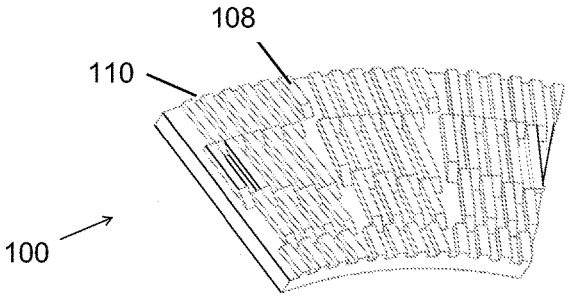
Figure 2F:
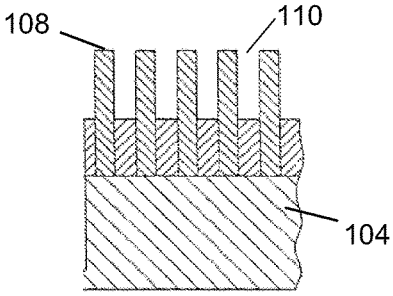

Dimensions such as bar (aka blade) height and width, and groove width are best illustrated in FIG. 2F. Bar height typically ranges from 2-10 mm; and bar/blade width typically ranges from 1-6 mm. Groove width typically ranges from 1-6 mm. The ratio of blade width to groove width can vary from 0.3 to about 4, more typically from about 0.5 to 2.0. Diameters of disc can range from about 18 inches (46 cm) to about 42 inches (107 cm), but a 24 inch (61 cm) disc is a common size. Regardless of configuration, the key property of any refiner disc or cone is the total cutting edge length that is presented in one rotation (CEL), which is calculated from the number and angle of the bars and the differential radius of the sector containing the bars. Finer blades with more bars of narrower width produce a larger CEL, and conversely, coarser blades with fewer bars of wider width produce a smaller CEL.

Figure 5:
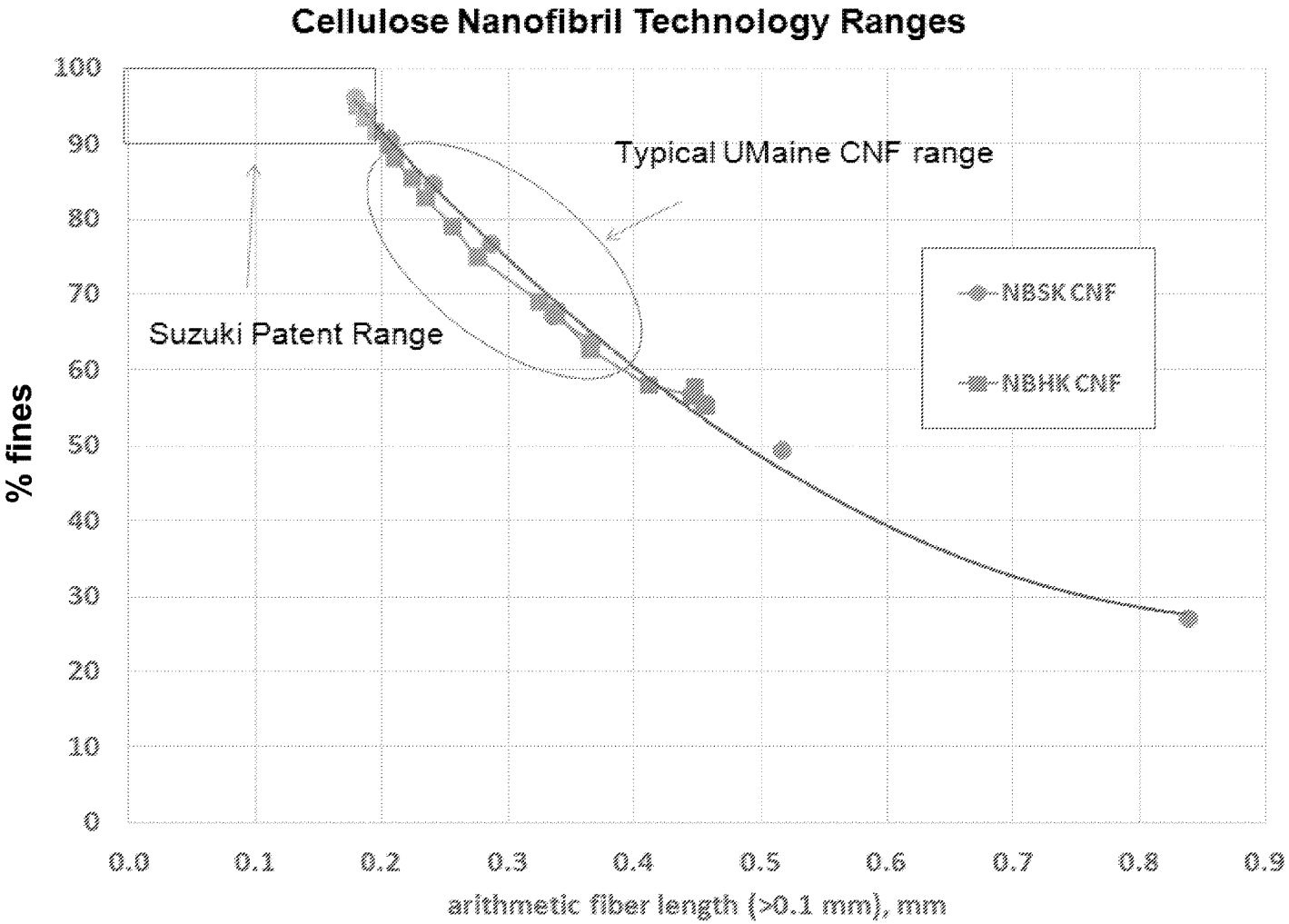
FIG. 5 is a graph showing the relationship between % fines and fiber length in accordance with one embodiment of the invention.

As fiber length decreases, the % fines increases. FIG. 5 illustrates this. Any suitable value may be selected as an endpoint, for example at least 80% fines. Alternative endpoints may include, for example 70% fines, 75% fines, 85% fines, 90% fines, etc. Similarly, endpoint lengths of less than 1.0 mm or less than 0.5 mm or less than 0.4 mm may be used, as may ranges using any of these values or intermediate ones. Length may be taken as average length (length-weighted average is most common), median (50% decile) length or any other decile length, such as 90% less than, 80% less than, 70% less than, etc. for any given length specified above.

The extent of refining may be monitored during the process by any of several means. Tappi standard T 271 om-02 (2002) describes the methods using polarized light and also the various weighted length calculations. Optical instruments can provide continuous data relating to the fiber length distributions and percent fines, either of which may be used to define endpoints for the refining stage. Such instruments are employed as industry standard testers, such as the TechPap Morphi Fiber Length Analyzer. Refining produces a distribution of fiber lengths and the instruments typically are capable of reporting the distribution as well as one or more of the various average length measurements.

The slurry viscosity (as distinct from pulp intrinsic viscosity) may also be used as an endpoint to monitor the effectiveness of the mechanical treatment in reducing the size of the cellulose fibers. Slurry viscosity may be measured in any convenient way, such as by a Brookfield viscometer.

Energy Efficient Design for CNF Refining

Figure 4:
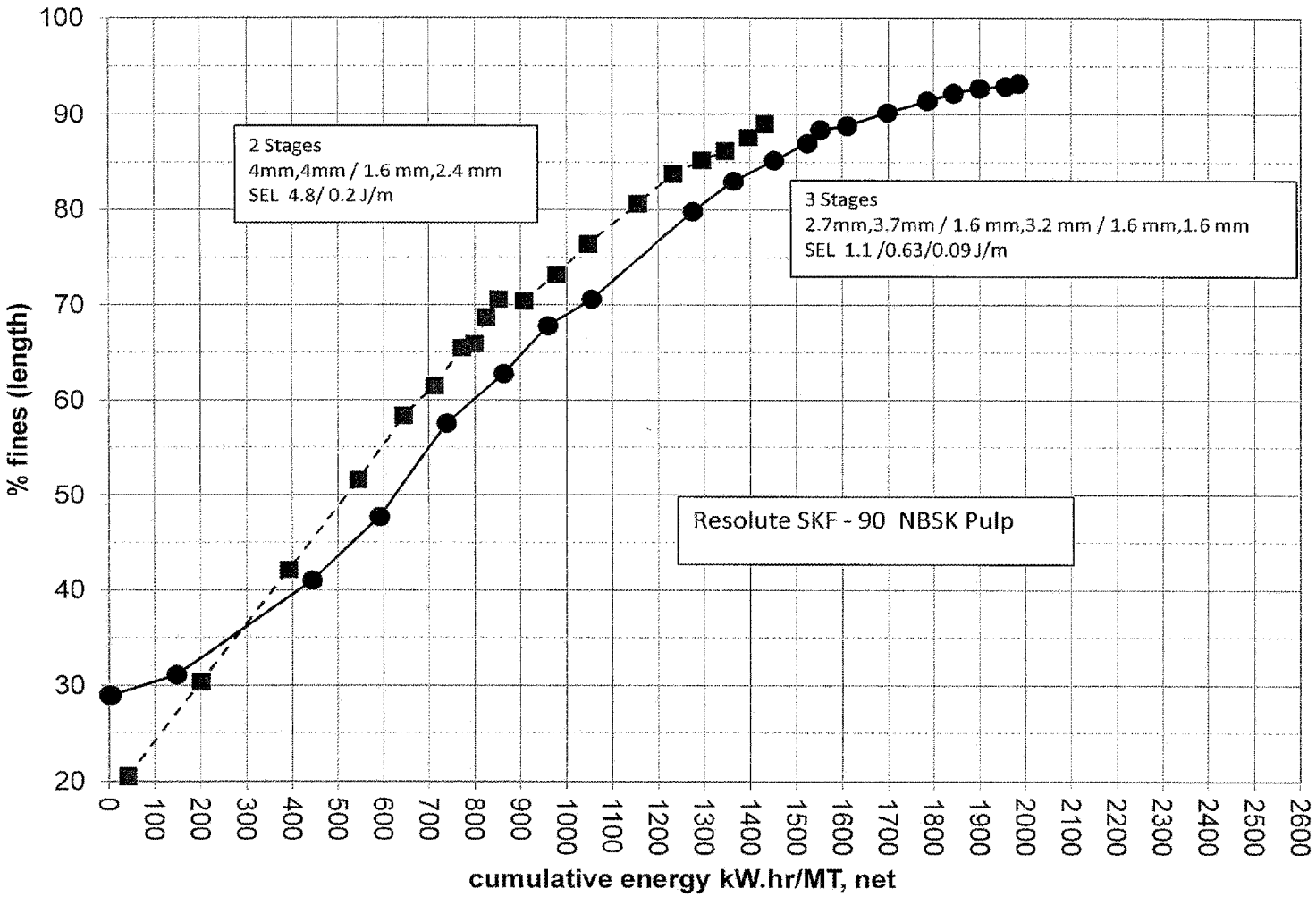
FIG. 4 is graph showing the effects of plate pattern and high first stage specific edge load on energy required to achieve a given percent fine level or quality of fibrillated cellulose.

The process disclosed in this specification is sufficiently energy efficient as to be scalable to a commercial level. Energy consumption may be measured in any suitable units. Typically a unit of Power*Hour is used and then normalized on a weight basis. For example: kilowatt-hours/ton (KW-h/ton) or horsepower-days/ton (HP-day/ton), or in any other suitable units. An ammeter measuring current drawn by the motor driving the comminution device is one suitable way to obtain a power measure. For relevant comparisons, either the refining outcome endpoints or the energy inputs must be equivalent. For example, "energy efficiency" is defined as either: (1) achieving equivalent outcome endpoints (e.g. slurry viscosity, fiber lengths, percent fines) with lesser energy consumption; or (2) achieving greater endpoint outcomes (e.g. slurry viscosity, fiber lengths, percent fines) with equivalent energy consumption. FIG. 4 shows a net energy curves for a 2-stage process and a 3-stage process to according to various embodiments of the invention.

As described herein, the outcome endpoints may be expressed as the percentage change; and the energy consumed is an absolute measure. Alternatively the endpoints may be absolute measures and the energies consumed may be expressed on a relative basis as a percentage change. In yet another alternative, both may be expressed as absolute measures. This efficiency concept is further illustrated in FIG. 4.

The treatment according to the invention desirably produces energy consumption reductions of at least about 2%, at least about 5%, at least about 8%, at least about 10%, at least about 15%, at least about 20% or at least about 25% compared to energy consumption for comparable endpoint results without the treatment. In other words, the energy efficiency of the process is improved by at least about 2%, at least about 5%, at least about 8%, at least about 10%, at least about 15%, at least about 20%, at least about 25%, or at least about 30%.

As is known in the art, the refiners require a certain amount of energy to run them even under no load. The gross energy consumed when loaded with pulp is the more relevant measure, but it is also possible to subtract the "no-load" consumption to arrive at a net energy consumed for refining. This net energy is important to the calculation of Specific Edge Loading (SEL) as described in the Background. Furthermore, it is known that as a refining process continues, the SEL will decrease somewhat over time. This leads to the existence of a beginning SEL, a final SEL which is lower than the beginning SEL, and an average SEL over the entire period. Unless otherwise noted, applicants refer to beginning SEL in describing the processes of the invention.

It has been found that specific arrangements of the mechanical refiners can achieve an unexpected reduction in the energy requirements of the process, thereby lowering overall manufacturing costs. The method includes processing a slurry of cellulosic fibers, preferably wood fibers, which have been liberated from the lignocellulosic matrix using a pulping process. The pulping process may be a chemical pulping process, such as the sulphate (Kraft) or sulfite processes; or a mechanical pulping process, such as a thermomechanical process. To such pulps are added various levels of the CNF according to the present invention.

CNF is generally produced by mechanical refining. The process according to the invention includes first and second mechanical refiners which apply shear to the fibers. The refiners can be low consistency refiners. The shear forces help to break up the fiber's cell walls, exposing the fibrils and nanofibrils contained in the wall structure. As the total cumulative shear forces applied to the fibers increase, the concentration of nanofibrils released from the fiber wall structure increases. (See FIG. 4) The mechanical treatment continues until the desired quantity of fibrils is liberated from the original fiber structure.

Figure 3A:
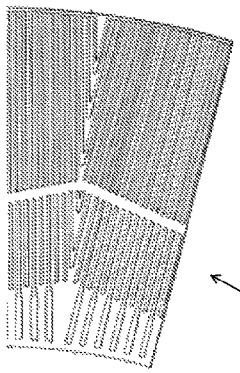
FIGS. 3A to 3F are views of various disc plate configurations useful in disc refining according to the invention.
Figure 3B:
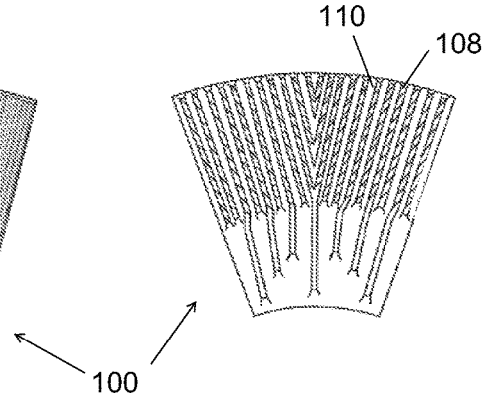
Figure 3C:
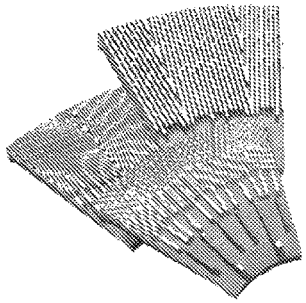
Figure 3D:
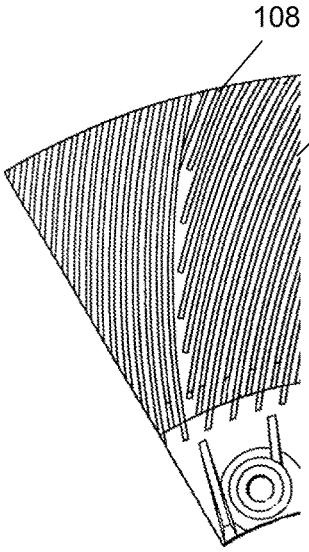
Figure 3E:
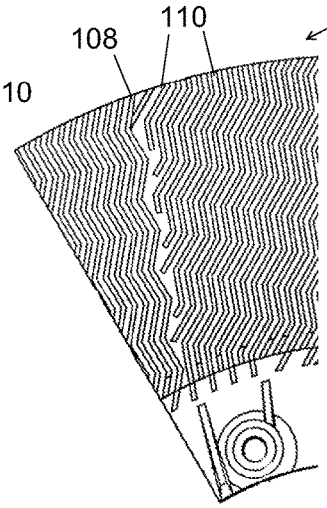
Figure 3F:
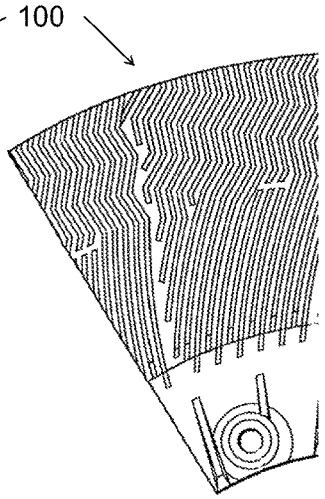

Referring to FIGS. 2A to 3F, a mechanical disc refiner 100 includes a rotating plate or "rotor" 104 and a stationary plate or "startor" 106. As shown in FIG. 3F in particular, the plates 104, 106 include blades 108 defining grooves 110. The cellulosic material flows from one of the discs into the narrow, flat space between the discs, and then exits via the other disc. The cellulosic material is broken into finer and shorter fibers by the shear forces acting on the material by the relative motion of the bars on the plates, and is compressed and defibrillated by the closely spaced blade surfaces.

Although disc refiners and disc plates are shown as one embodiment, it should be understood that the present invention is not limited to disc refiners, but includes conical refiners as well. In this context, "disc" or "plate" as used herein refers not only to the relatively planar surfaces of disc refiners, but also to the conical grinding surfaces of conical refiners. The rotor and stator aspects are similar in conical refiners, as are the concepts of CEL and SEL.

A number of mechanical treatments to produce highly fibrillated cellulose (e.g. CNF) have been proposed, including homogenizers and ultrafine grinders. However, the amount of energy required to produce fibrillated cellulose using these devices is very high and is a deterrent to commercial application of these processes for many applications. For example, Suzuki (U.S. Pat. No. 7,381,294 mentioned in the background) teaches that, for the preferred method of using two refiners sequentially, the first refiner should be outfitted with refiner disc plates with a blade width of 2.5 mm or less and a ratio of blade to groove width of 1.0 or less. Refiner disc plates with these dimensions tend to produce refining conditions characterized by low specific edge load, also known in the art as "brushing" refining, which tends to promote hydration and gelation of cellulose fibers. Suzuki then teaches that the second refiner should have refiner disc plates with a blade width of 2.5 mm or more and a ratio of blade to groove width of 1.0 or more. Refiner disc plates with these dimensions tend to produce refining conditions characterized by high SEL, also known in the art as "cutting" refining, which tends to promote shortening of cellulose fibers.

Although Suzuki does not calculate the SEL for the process, applicants have done so, using reasonable assumptions and the data from Suzuki's Table 1, and the result is in the table below:

TABLE 1

| Suzuki refining data and measures derived therefrom | | | | | | |
|---|---|---|---|---|---|---|
| | Given by Suzuki Table 1 | | | Estimated by Applicants | | |
| | Blade Width (mm) | Groove Width (mm) | Ratio (blade width to groove width) | Cutting Edge Length, (km/rev) | Range of SEL, (J/m) | Average SEL, (J/m) |
| Stage 1 | 2.0 | 3.0 | 0.67 | 9.18 | 1.2-0.3 | 0.75 |
| Stage 2 | 3.5 | 2.0 | 1.75 | 6.78 | 1.6-1.5 | 1.55 |

Thus, the Suzuki method of increasing blade width results in lower CEL and higher SEL for the second and subsequent stages. The relatively long, highly swollen or gelled fiber produced in the first refiner stage does not permit the second refiner stage to be operated at high efficiency because, in part, the fiber network is not capable of supporting the high specific load across the relatively few blade crossings, requiring the second refiner to be operated with a large plate gap, lower applied power levels and therefore, low power efficiencies. Furthermore, the coarser, wide blade widths of the refiner discs in the second refiner are not efficient in "brushing" or fibrillating the fibers resulting in more time operating with low energy efficiencies. Consequently, the overall energy required to produce fibrillated cellulose is high, increasing the cost of manufacturing.

Under the concept disclosed in this specification, two or more refiners are arranged sequentially with configurations that produce a higher SEL in the initial stage, and lower SEL in the second and subsequent stages. For example, a higher SEL can be produced in the first refiner by outfitting it with disc plates having blade widths greater than about 2.5 mm, preferably greater than about 3 mm. Further, in some embodiments the ratio of blade width to groove width is 0.75 or greater. Refiner disc plates with these dimensions in the first refiner tend to produce refining conditions characterized by high specific edge load, also known in the art as "cutting" refining, which tends to promote shortening of cellulose fibers. The fibers exiting this stage of treatment have a smaller and narrower fiber length distribution and are less swollen, and have a lower yield stress, making the slurry easier to pump and process through the remainder of the treatment process. Viscosity does not increase appreciably during this first stage.

Meanwhile, the second and any subsequent refiner stages may be outfitted with plates producing lower SEL, for example, by using discs with decreasing blade widths. Second stages may employ discs with blades widths that are less than about 2.5 mm, preferably about 2 mm or less, with a ratio of blade to groove width of about 1.0 or less. The shorter fiber length resulting from the first refiner permits finer refiner discs, i.e., narrower blade widths, to be used in subsequent refiners with less concern for plugging, thereby increasing efficiency. The finer refiner disc plates operate at lower specific edge load, and are more efficient in fibrillating the fiber. The result is a shortening of the time to manufacture highly fibrillated cellulose. In addition, the plates having finer blade widths can be operated at smaller gaps and higher loads, and thus higher energy efficiency, without clashing.

Less total energy is consumed if a high refining intensity (e.g high SEL) is used in the early stages of the process, i.e., the first refiner. From the formula for SEL:

$$SEL=(p-p^0)/\Omega*CEL$$

one can see that there are a number of ways to increase SEL in the beginning stage. For example, lowering either rotational speed or CEL or both will increase the value of the fraction, assuming net power is constant. Consequently, one method of accomplishing this is by employing a coarse plate pattern (having a lower CEL) in the first stage. This may have a secondary effect of improving the refining efficiency by reducing the no load energy consumption as well.

Employing high intensity or high SEL refining in the first stage also reduces the yield stress of hardwood kraft pulp slurries by as much as 20% compared to unrefined pulp. This lowers the energy required to initiate flow and improves the rheology of the slurry, thus saving pumping energy costs and improving refiner efficiency. The prior art, specifically Suzuki, teaches that low intensity refining should be used in the first refining stage. But, this undesirably increases the yield stress of slurries of hardwood kraft by 23% over unrefined pulp. The result is an increase in the energy required to recirculate the fiber slurry through the refiner, adding to the energy required to produce the highly fibrillated cellulose.

The use of larger refiner blade widths and higher SEL in the first refiner means that less time and energy are required to produce highly fibrillated cellulose. Refiner disc plates can be loaded without plugging or clashing, and finer, more efficient fibrillating plate patterns can be operated in the later refiner stages than is possible with the prior art.

According to the invention, the SEL of the first stage should be higher than the SEL of second and subsequent stages. For example, in applicants' processes, the first stage SEL may range from about 5.0 to about 0.5 J/m over the course of a run. Knowing that the SEL decreases during a run, the beginning or initial SEL of a first stage may be greater than 1.0, for example from about 1.5 to about 8.0 J/m, or from about 2.0 to about 5.0 J/m, whereas the beginning or initial SEL of a second or subsequent stage may be less than 1.0 J/m, such as from about 0.05 to about 0.95 J/m, or from about 0.1 to about 0.8 J/m.

Said differently, the beginning SEL of the first stage should be significantly higher than the beginning SEL of second and subsequent stages. In some embodiments, the beginning SEL of the first stage is 2 to 40 times higher than the beginning SEL of subsequent stages; for example from 5 to 30 times higher or 6 to 20 times higher than the beginning SEL of subsequent stages.

One method to achieve these relative differences in SEL, is by varying the configuration of the blades and grooves of the disc plates to alter the cutting edge length (CEL). A "coarse" refiner plate with fewer, wider blades has a higher ratio of blade width to groove width and a lower CEL compared to a "fine" plate that has a greater number of narrower blades or bars. A refining process that uses lower CEL plates in a first stage and higher CEL plates in a subsequent stage will improve energy efficiency provided other conditions remain relatively constant. Likewise, a refining process that uses plates with a higher blade:groove width ratio in a first stage and lower blade:groove width ratio in a subsequent stage will improve energy efficiency provided other conditions remain relatively constant.

In some embodiments, the ratio of blade:groove widths of the plates of the first refiner is 1.0 or greater, and the ratio of blade:groove widths of the plates of the second refiner is 1.0 or less. In some embodiments, the blades of the first refiner have widths greater than 2.5 mm, and the blades of the second refiner have widths less than 2.5 mm. For example, the blades of the first refiner may have widths greater than or equal to 3.0 mm, and the blades of the first refiner may have widths equal to or less than 2.0. Such blade configurations produce the desirable blade:groove width ratios and CELs that contribute to higher SEL in the first stage.

FIG. 4, illustrates the effect of plate pattern and specific edge load on energy required to achieve a given percent fines level or quality of fibrillated cellulose. One curve is from a two stage process according to the invention having high SEL (4.8 J/m) followed by lower SEL (0.2 J/m). The second other curve shows the results of a three stage process wherein only a modest SEL (1.1 J/m) is used in the first stage, followed by decreasing SEL. In the first curve, the beginning SEL is 24 times the SEL of the second stage, while in the second curve, the beginning SEL is only about 1.7 times the SEL of the second stage. For all end points above 35% fines, the two stage process is more efficient—using less energy to reach an equivalent endpoint—than the three stage process.

Paper Products Containing CNF and their Improved Properties

In certain important embodiments, the cellulose nanofibers—whether prepared as above or by another process—may have a fiber length from about 0.2 mm to about 0.5 mm, preferably from about 0.2 mm to about 0.4 mm. Paper products manufactured using such cellulose nanofibers has improved properties. According to embodiments of the invention, a certain amount of NFC is added to the pulp used in making the paper. For example, from about 2% to about 40% of the fiber on a dry weight basis may be NFC; or from about 5% to about 25% in some embodiments. The addition of NFC produces some advantages in the paper products as described below.

Many properties of paper can and have been measured, including those described below. As the fibers are more refined, the surface area tends to increase and the fiber length tends to decrease. This leads to changes in various properties of the paper in either a good or bad direction. If a particular property improves with refining, it is labeled a "good" property. "Good" properties include freeness, tensile strength, porosity, internal bond, etc. But if the property deteriorates with refining, it is labeled a "bad" property. These include shrinkage and tear. One goal of refining is to affect the "good" properties to a greater degree than the "bad" properties; i.e. to improve the ratio of good/bad properties.

Freeness is a standard measure in the paper industry, also known as the drainabilty of the pulp. Freeness is related to the ability of the fibers to imbibe or release water. While there are multiple methods for measuring freeness, one frequently used measure is the Canadian Standard Freeness or CSF (Tappi Standard Method T 227 om-04 (2004)), which is the volume (in ml) of water that is drained from 3 grams of oven dried pulp that has been immersed in a liter of water at 20 C (higher CSF values means less water is imbibed). Alternative measure of Freeness are the Schopper-Riegler (SR) method, which measures a rate of drainage, so that lower SR values means less water is imbibed; and the Williams Slowness (WS) method, which measures the time for a pulp to drain (lower WS values means less water is imbibed). A chart correlating typical values for each of these methods is found at: http://www.aikawagroupcom/freeness-conversion-table.php.

Unrefined hardwood pulps have a CSF in the range of 600 to 500 ml; while unrefined conifer pulps hold less water and have a CSF in the range of 760 to 700 ml. As fibers are refined they tend to hold more water and the CSF decreases. For example, Uncoated Freesheet (UFS) grade paper (typically used for copy paper) has a CSF of about 300 to 400 ml. In contrast, the more highly refined or densified papers like SuperCalendered Kraft (SCK) and Glassine grade papers currently used as release base papers have lower CSF freeness in the range of about 170 to 100 ml.

As used herein, the term "fiber freeness" and "initial freeness" refers to the initial freeness of the pulp fibers prior to the addition of any cellulose nanofibers (CNF). Typically, the freeness of each type of pulp fiber is measured before the fibers are blended into the pulp. In contrast, the "headbox freeness" refers to the freeness of all the pulp fibers—including the CNF, and any pigments, binders, clays fillers, starches or other ingredients—blended together. The higher the headbox freeness, the faster and more easily the water can be removed from the forming web. This, in turn, offers opportunity to increase production rates, reduce energy usage, or a combination of both, thereby improving process efficiency. While the addition of CNF to less refined pulps may lower the headbox freeness somewhat, a key advantage of the use of less refined, high freeness pulps, is the dimensional stability and other physical properties of the papers made. In addition to improved dimensional stability, the papers exhibit good tensile strength and tear strength, and high opacity.

Example 1

Figure 6A:
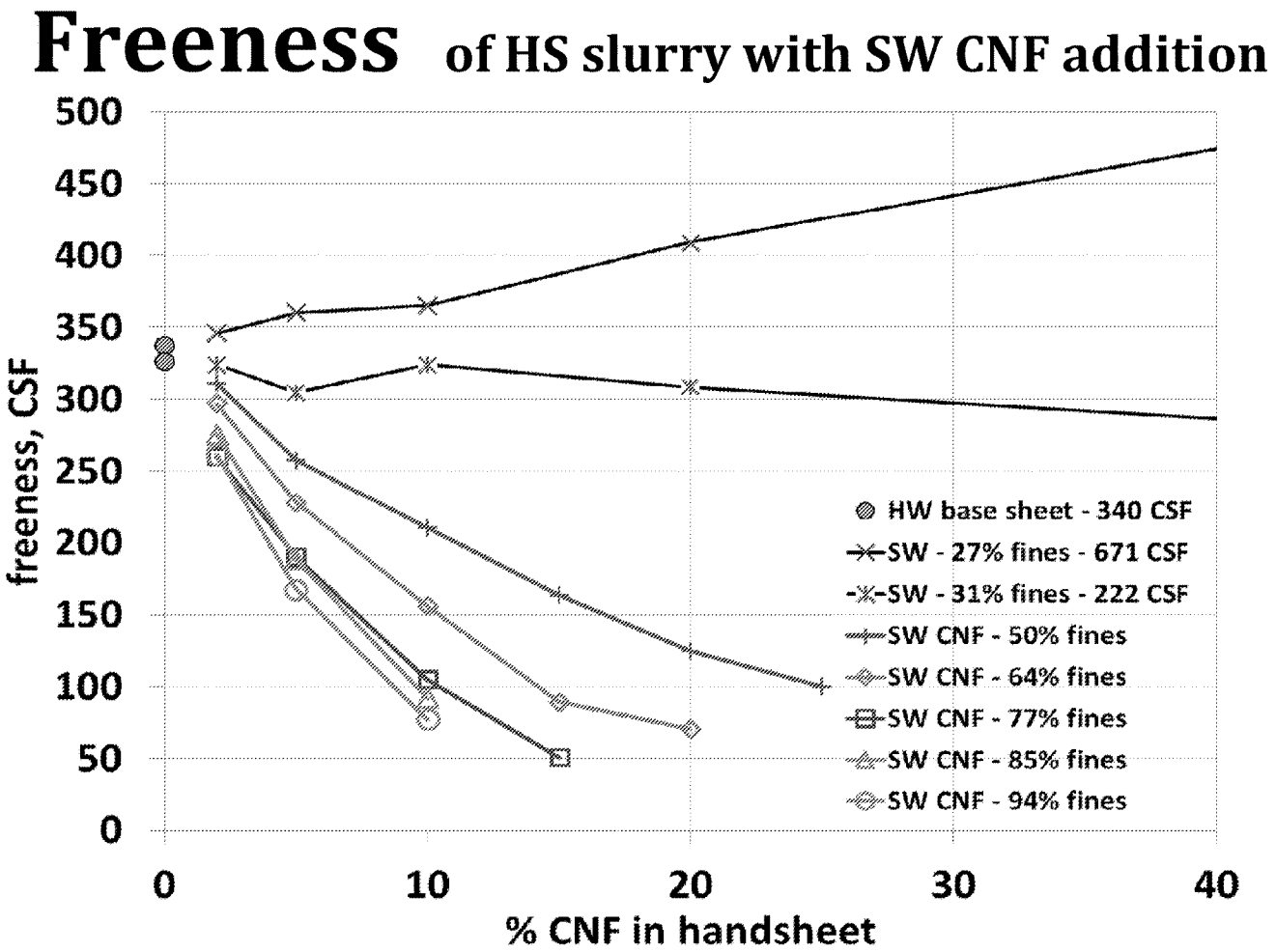
FIGS. 6-11 are graphs of data results of paper products and their properties.
Figure 6B:
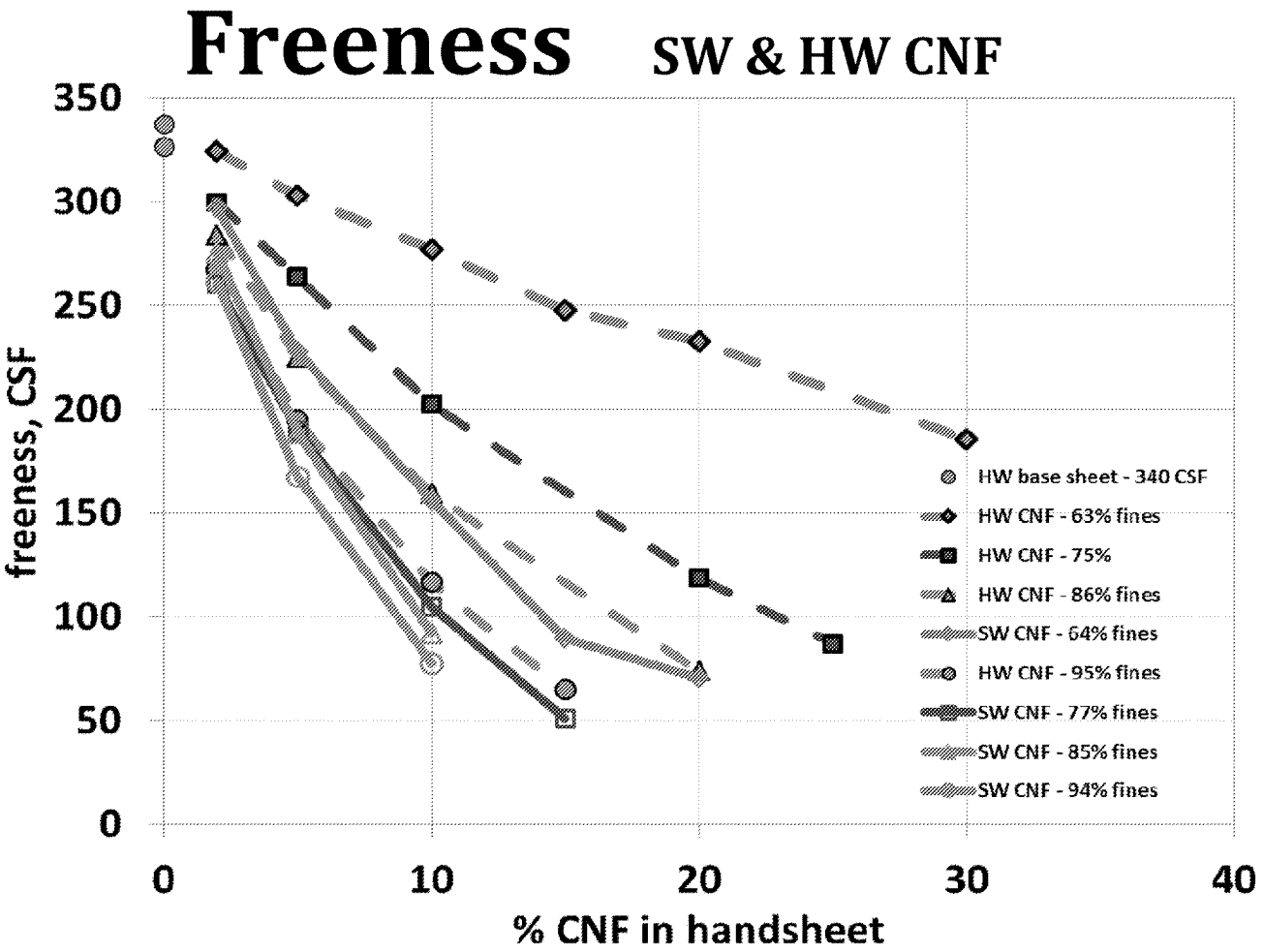

Hand sheets are prepared with varying amounts (about 2.5% to about 30%, dry wt basis) of CNF added, the CNF having been refined in several batches to various stages of refining from about 50% fines to about 95% fines. Initial freeness, headbox freeness and freeness reductions are shown in FIGS. 6A and 6B for various handsheet (HS) compositions of cellulose pulps having 340 ml CSF initial fiber freeness of the hardwood (HW) pulp. In FIG. 6A, the amount of CNF added to the HS is on the x axis, and the property, in this case CSF, is on the Y axis. The various curves represent a CNF fines level (95%, 85%, 77%, 64% and 50%), at the different levels of CNF in the HS (ranging from about 2% to 20% CNF). There are two reference curves on the SW CNF graphs—one is unrefined SW added to the HW base (27% fines-671 CSF), and the second is refined SW (31% fines and 222 CSF) added to the HW base. FIG. 6A illustrates that a freeness reduction correlates to both: (1) increasing the level of fines in the CNF at a given % CNF in the HS (points along a vertical line); and (2) increasing the level of % CNF in the HS for a given % fines (along a curve).

FIG. 6B is similar to FIG. 6A, except that the initial 340 ml CSF base HW pulp is mixed with CNF from both HW and SW sources in concentrations varying from about 25 to about 30% of the paper composition, and at incremental fines levels from about 95% to about 64% as shown on the graph.

Example 2

Figure 7A:
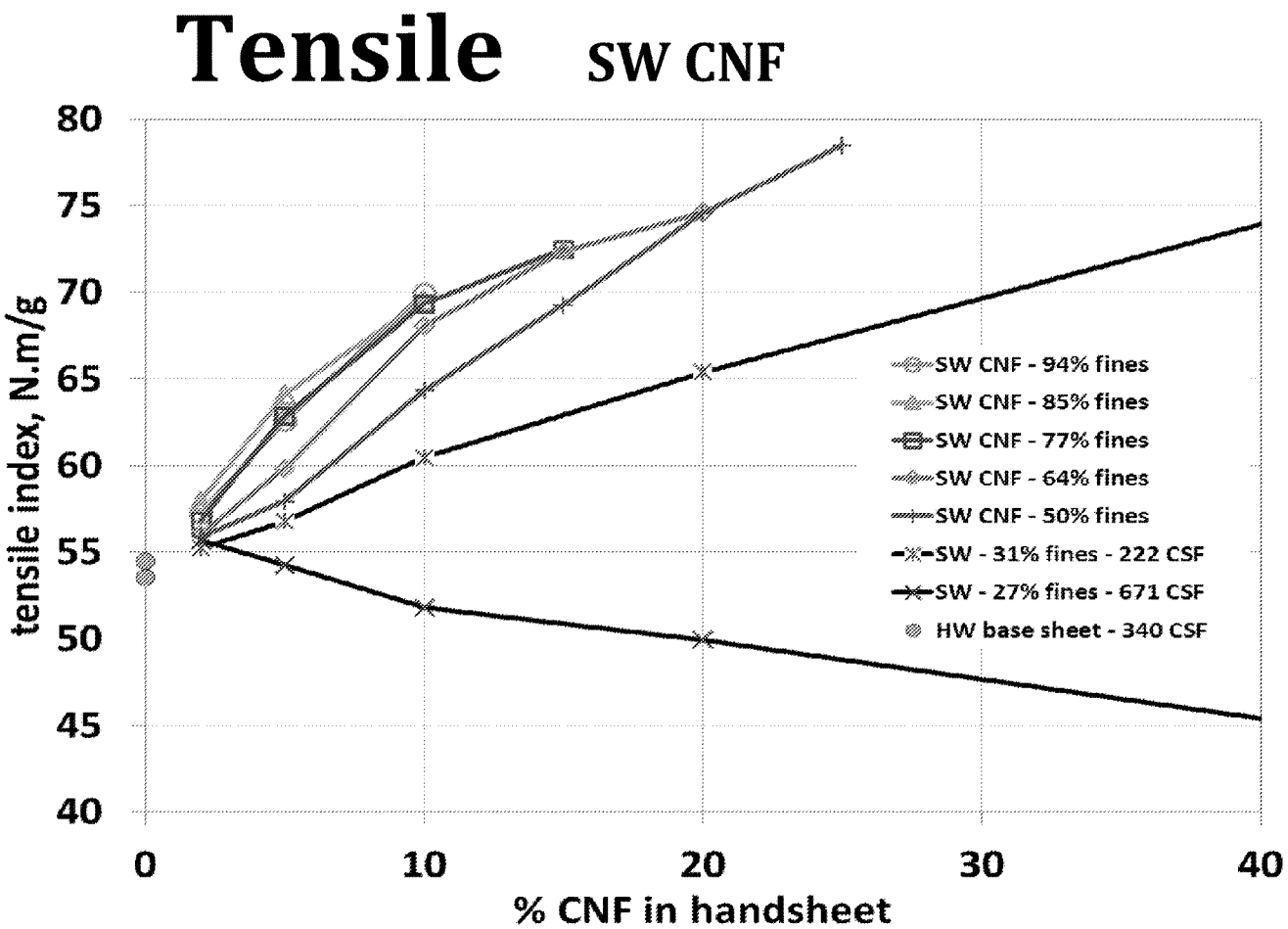
Figure 7B:
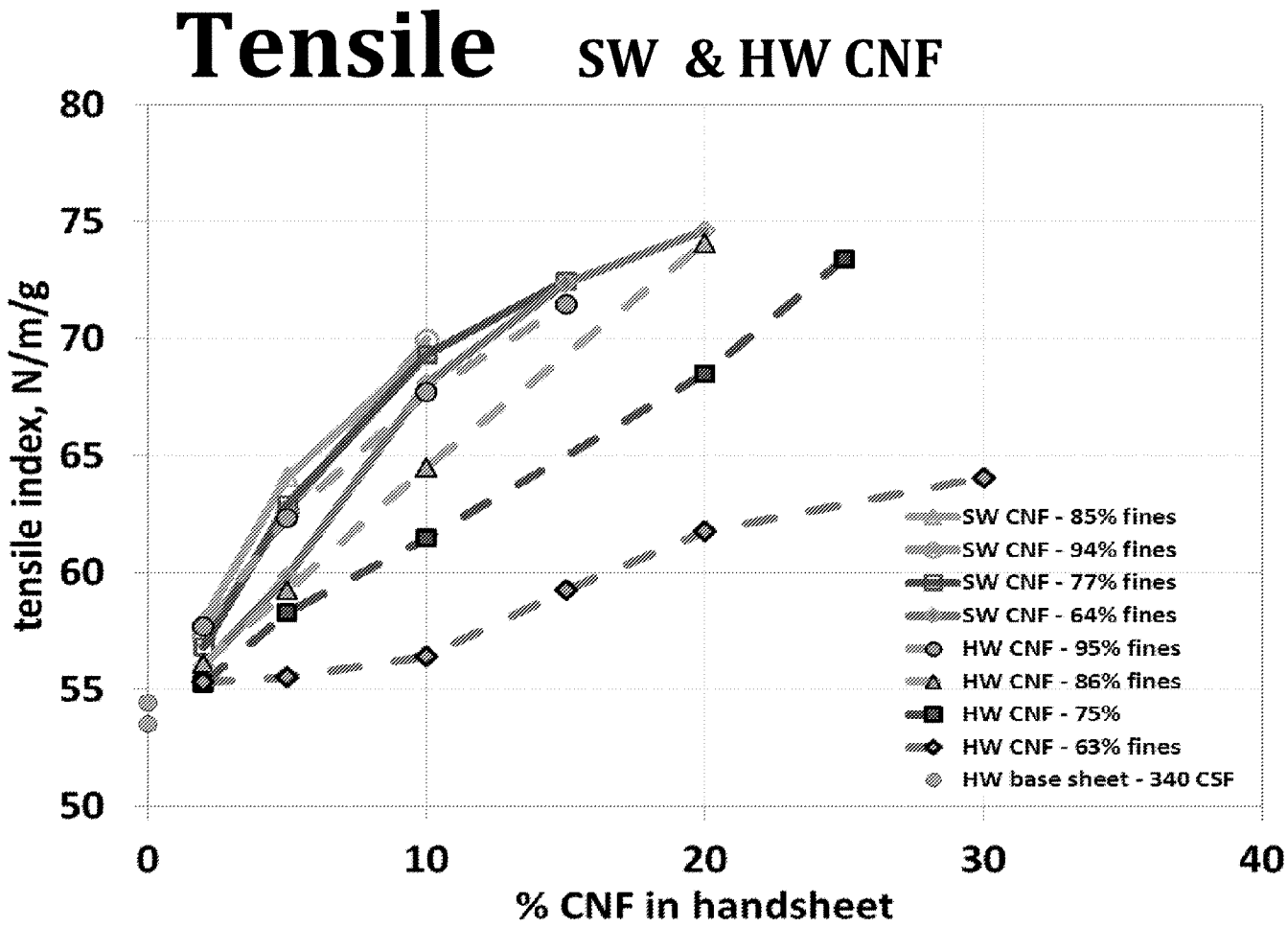

Handsheets are prepared as in Example 1. The handsheets were tested for tensile strength in accordance with Tappi standard T 494 om-01 (2001). In FIG. 7A, the initial 340 ml CSF kraft base HW pulp is mixed with softwood fibers only. The comparative/control samples were refined to a high freeness level (671 ml CSF) and a low freeness level (222 ml CSF). Five test CNF samples were refined ranging from 50% fines to 95% fines and added to the base at percentages from about 2.5% to about 25%. Very high freeness pulps do not bond well and do not develop tensile strength readily. FIG. 7B is similar to FIG. 7A, except that the initial 340 ml CSF base HW pulp is mixed with CNF from both HW and SW sources in concentrations varying from about 2.5% to about 30% of the paper composition, and at incremental fines levels from about 95% to about 64% as shown on the graph. The tensile strength of the handsheet increases with increasing CNF concentration and the % fines level of the CNF.

Example 3

Handsheets are prepared as in Example 1. Gurley Porosity (or Gurley density) is a measure of the paper's permeability to air and refers to the time (in seconds) required for a given volume of air (100 cc) to pass through a unit area (1 in.$^2$=6.4 cm.$^2$) of a sheet of paper under standard pressure conditions. (See Tappi T 460). The higher the number, the lower the porosity. While coatings and sizing can impact porosity, it is desirable for an unsized and uncoated base paper used for release grades to have a Gurley Porosity value of at least about 300, or at least about 400, or at least about 500, or at least about 600, or at least about 800, or at least about 1000 seconds.

Figure 8:
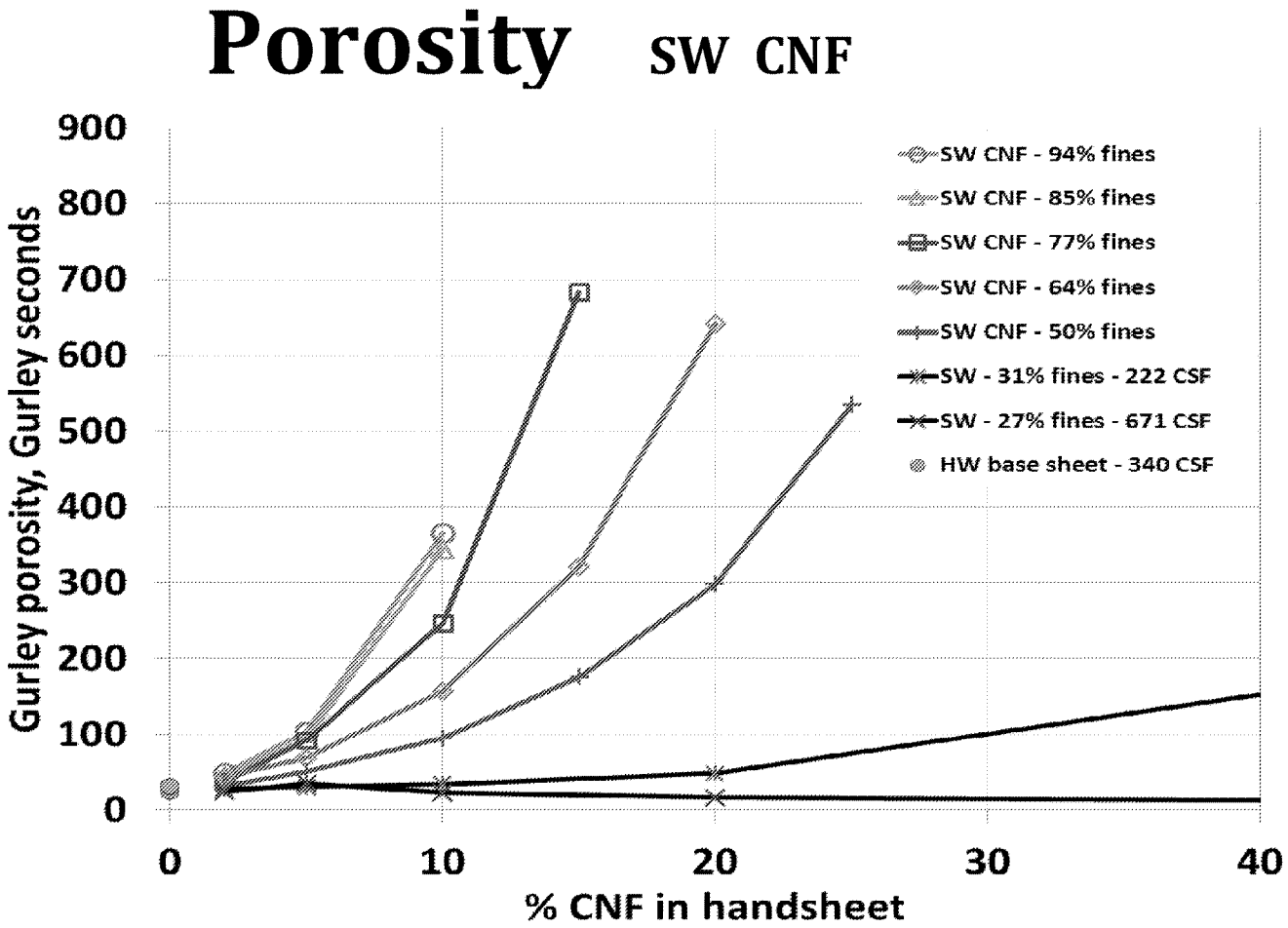

Gurley Porosity of the base pulp HS is about 25 as shown in FIG. 8, and the values increase (lower porosity) for CNF-containing samples with varying % fines (94%, 85%, 77%, 64% and 50%) at varying concentrations (about 2% to about 25%) as shown in the chart. Two reference standards are shown as before.

Example 4

Figure 9:
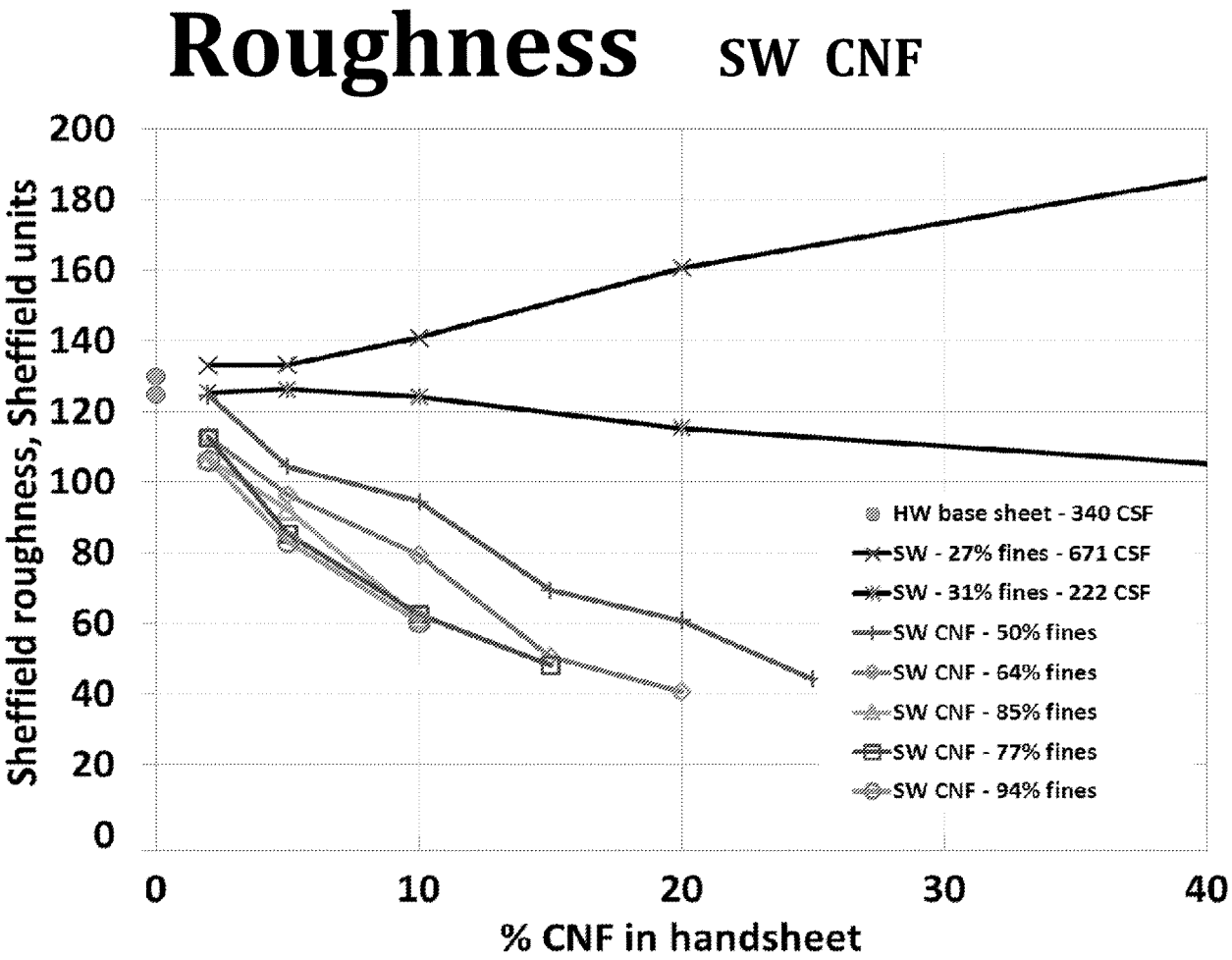

Smoothness is a measure of the evenness or roughness of the surface of the fibrous sheet. One measure of this property is the Parker Print Surf (PPS) which measure the surface variability (e.g. from peaks to valleys) in microns (μm). Smoother surfaces have smaller variability and lower PPS values. Tappi Standard T-555 (om 2010) explains this measure in more detail. Another measure of roughness is the Sheffield test, which is an air-leak test similar to the PPS test. As shown in FIG. 9, the Sheffield Roughness decreased from an initial level (for base HW pulp) of about 130 for CNF-containing samples with varying % fines (94%, 85%, 77%, 64% and 50%) at varying concentrations (about 2% to about 25%) as shown in the chart. Two reference standards are shown as before.

Example 5

Handsheets are prepared as in Example 1. Dimensional Stability refers to the ability of the paper sheet to maintain its dimensions over time. This property is highly dependent on humidity (ambient moisture) since the fibers tend to swell with moisture absorption, as much as 15-20%. All papers expand with increased moisture content and contract with decreased moisture content, but the rate and extent of changes vary with different papers. While dimensional stability is a "good" property, it is typically measured as its inverse "bad" property—shrinkage in length or width dimensions expressed as a percent of the initial value, as described in Tappi Standard T 476 om-11 (2011). Papers made from more highly refined pulps, such as SCK and Glassine release papers, tend to be more sensitive to moisture absorption and consequent shrinkage and curling. Ideally, shrinkage should be less than about 15%, but realistic targets for shrinkage vary with the level of pulp refining as shown by production run data in table A below. This table illustrates how the more highly refined papers are more sensitive to shrinkage.

TABLE A

Actual shrinkage by pulp type (extent of refining)

| Pulp Refining or Grade | Average Shrinkage (%) | Range of Shrinkage (%) |
|---|---|---|
| less refined, UFS | 8.6 | 5-11 |
| moderately refined, SCK | 10.6 | 7-14 |
| highly refined, Glassine | 13.3 | 11-15 |

Figure 10:
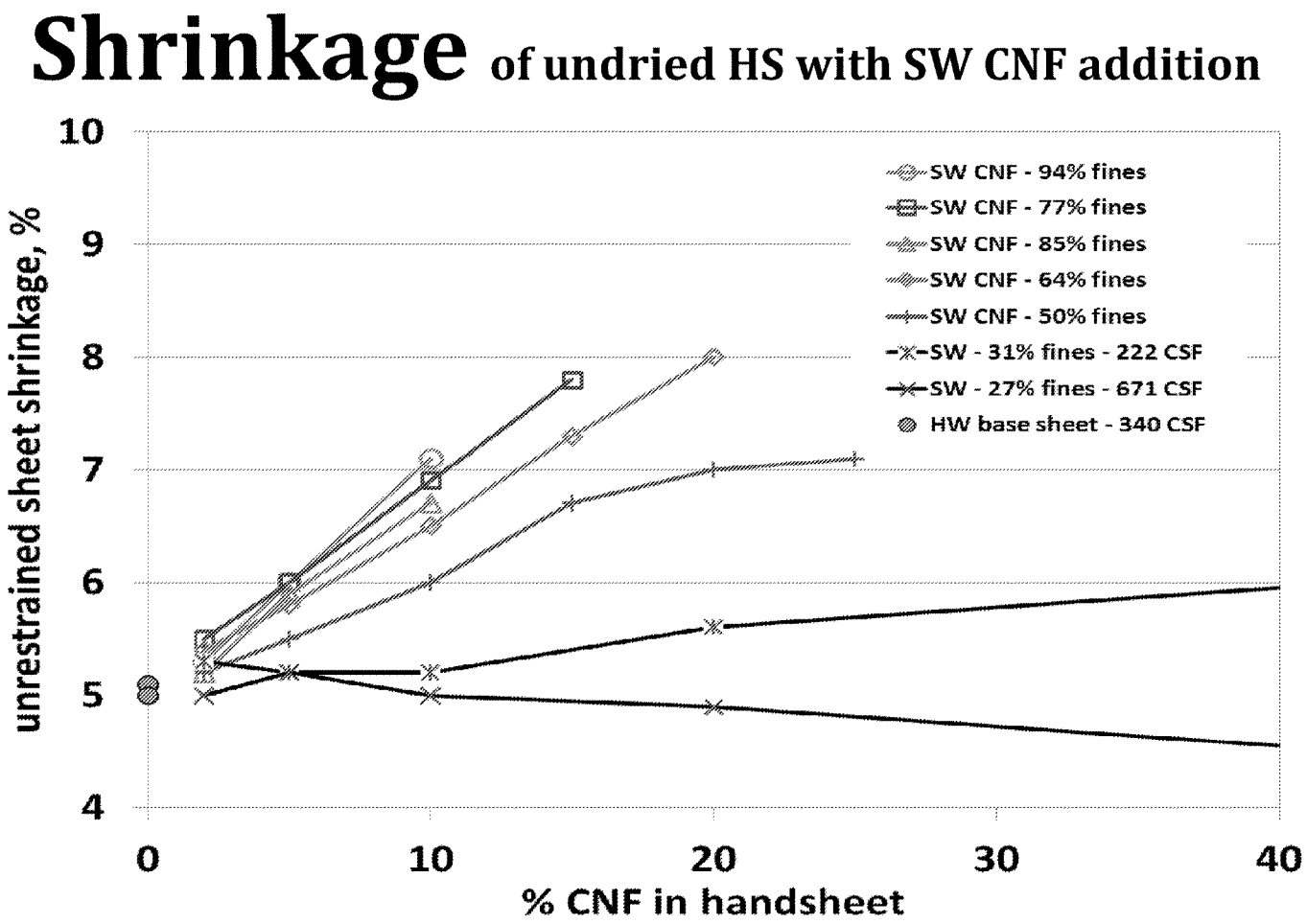

Dimensional stability is also shown in FIG. 10. Shrinkage percent increased with varying CNF additions as described above.

Example 6

Figure 11:
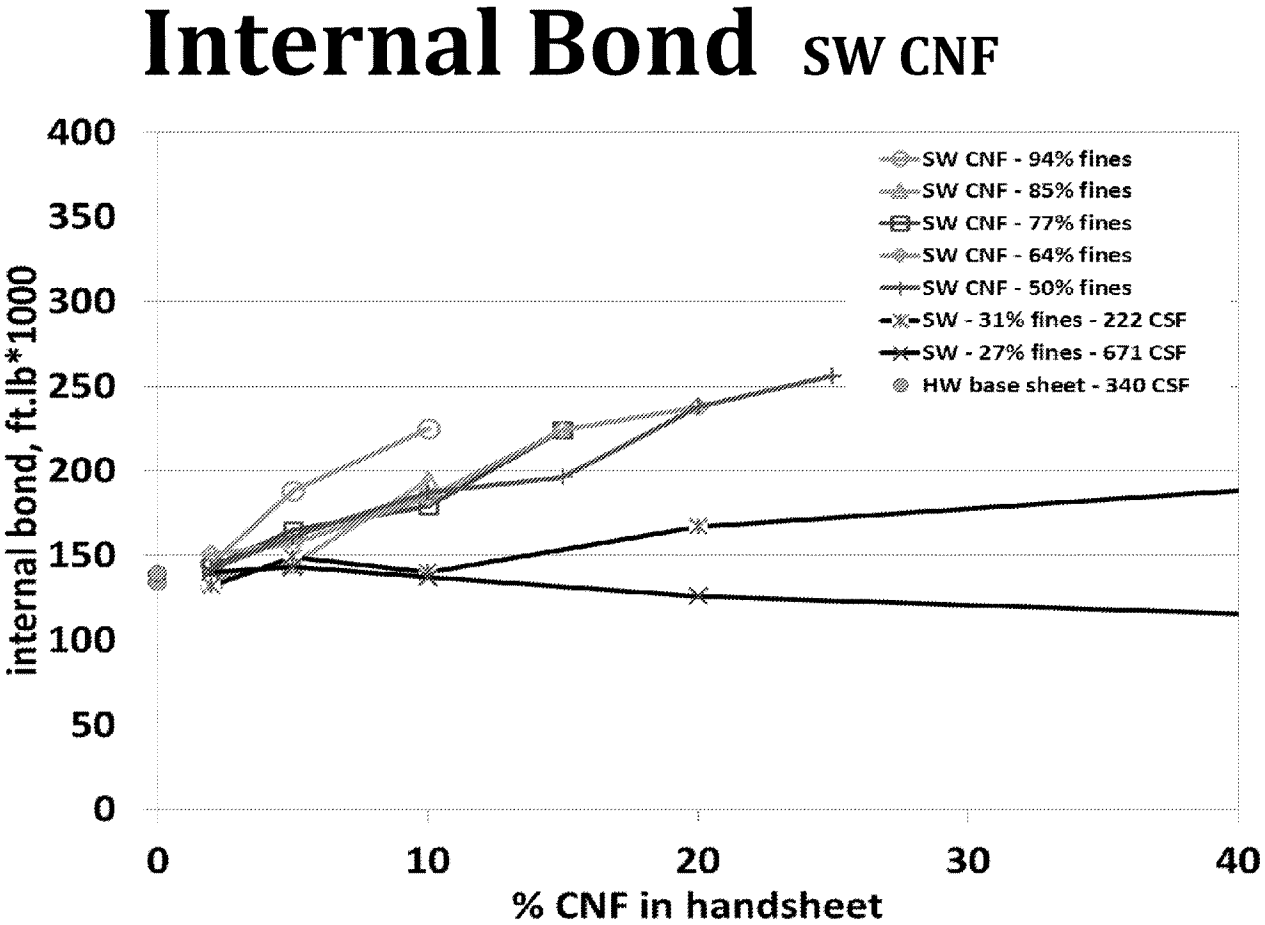

Handsheets are prepared as in Example 1. Tappi T 569 pm-00 (2000) describes a procedure for testing internal bond strength involving a hinged apparatus that, upon impact, rotates to pull a sheet of paper apart in a de-lamination sense as a measure of the bond strength holding the paper fibers together. FIG. 11 shows that the addition of CNF to base HW paper pulp increased the internal bond strength.

Example 7

Synergy grade of northern bleached kraft pulp, produced by Sappi Fine Papers North America as a blend of 85% hardwood kraft and 15% softwood kraft pulp, was refined in a PFI laboratory refiner to 4000 revolutions as is consistent for an Uncoated Free Sheet (UFS) standard. This furnish (295 SCF) was made into a handsheet as a control. To a test sample was added 100 ppt (5%) of CNF refined to 90% fines (length-weighted average) measured by the TechPap Morphi Fiber analyzer, and this furnish (102 CSF) also was made into a handsheet. Some of the "good" and "bad" properties of the control and test sheet are given in Table B, along with some calculated ratios of good-to-bad properties.

TABLE B

Handsheet Properties

| | GOOD Properties | | BAD Properties | |
|---|---|---|---|---|
| | Gurley | | | |
| Furnish | Porosity (sec.) | Tensile (lb.f/in) | Tear (gf) | Shrinkage (%) |
| Control - UFS Refining | 120 | 41.1 | 75.5 | 4.26 |
| UFS Refining - 100 lb./ton CNF | 739 | 43.1 | 74.5 | 5.12 |
| | Ratio Porosity to Shrinkage | Ratio Porosity to Tear | Ratio Tensile to Shrinkage | Ratio Tensile to Tear |
| Control - UFS Refining | 28.2 | 1.6 | 9.6 | 0.54 |
| UFS Refining - 100 lb./ton CNF | 144.3 | 9.9 | 8.4 | 0.58 |
| Percent change | 412% | 524% | −13% | 6% |

It can be seen from the above example that many of the "good" properties (porosity and tensile) are impacted to a greater degree than the "bad" properties (shrinkage and tear). The ratio of good to bad is highly positive for the porosity ratios, and mixed for the tensile ratios, but tensile-to-tear ratio does improve modestly.

The foregoing description of the various aspects and embodiments of the present invention has been presented for purposes of illustration and description. It is not intended to be exhaustive of all embodiments or to limit the invention to the specific aspects disclosed. Obvious modifications or variations are possible in light of the above teachings and such modifications and variations may well fall within the scope of the invention as determined by the appended claims when interpreted in accordance with the breadth to which they are fairly, legally and equitably entitled.

What is claimed is:

1. A process for forming cellulose nanofibers from a cellulosic material, comprising:

treating the cellulosic material with a first mechanical refiner having stator and rotor plates having a configuration of blades separated by grooves, the first refiner producing a first specific edge loading (SEL); and subsequently treating the cellulosic material with a second mechanical refiner having stator and rotor plates having a configuration of blades separated by grooves that is different than the configuration of the first refiner, the second refiner producing a second SEL;

wherein first SEL is greater than 1.0 J/m and is 2 to 40 times greater than the second SEL, to obtain cellulose nanofibers.

2. The process of claim 1 wherein the first SEL is in the range from about 1.5 to about 8.0 J/m.

3. The process of claim 1 wherein the configuration of blades separated by grooves on the plates of the first refiner produces a cutting edge length (CEL) that is lower than the CEL produced by the configuration of blades separated by grooves on the plates of the second refiner.

4. The process of claim 3 wherein the blades of the first refiner have widths greater than or equal to 3.0 mm, and the blades of the second refiner have widths equal to or less than 2.0 mm.

5. The process of claim 1 wherein the ratio of blade: groove widths of the plates of the first refiner is greater than the ratio of blade:groove widths of the plates of the second refiner.

6. The process of claim 5 wherein the ratio of blade: groove widths of the plates of the first refiner is 1.0 or greater, and the ratio of blade:groove widths of the plates of the second refiner is 1.0 or less.

7. The process of claim 1 wherein the treatment by the first refiner is carried out at a lower rpm than the treatment by the second refiner.

8. The process of claim 1 wherein the treatment by the second refiner is continued until the cellulose nanofibers have a fiber length from about 0.2 mm to about 0.5 mm.

9. The process of claim 1 wherein the first SEL is in the range from about 2.0 to about 5.0 J/m.

10. The process of claim 1 wherein the first SEL is 5 to 30 times higher than the second SEL.

11. The process of claim 1 wherein the first SEL is 6 to 20 times higher than the second SEL.

12. The process of claim 1 wherein the treatment by the second refiner is continued until an endpoint of at least 75% fines.

* * * * *